US008576240B2

(12) United States Patent
Cho et al.

(10) Patent No.: US 8,576,240 B2
(45) Date of Patent: Nov. 5, 2013

(54) DISPLAY APPARATUS AND METHOD OF DRIVING THE SAME

(75) Inventors: Joo Woan Cho, Asan-si (KR); Gicherl Kim, Asan-si (KR); Jaejoong Kwon, Suwon-si (KR); Sung-Kyu Shim, Seoul (KR); SEul-Gi Kim, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 646 days.

(21) Appl. No.: 12/639,827

(22) Filed: Dec. 16, 2009

(65) Prior Publication Data

US 2010/0328339 A1 Dec. 30, 2010

(30) Foreign Application Priority Data

Jun. 30, 2009 (KR) ..... 10-2009-0059244

(51) Int. Cl.
*G09G 5/02* (2006.01)
*G09G 5/10* (2006.01)

(52) U.S. Cl.
USPC ..... 345/589; 345/690

(58) Field of Classification Search
None
See application file for complete search history.

(56) References Cited

U.S. PATENT DOCUMENTS 5,381,241 A * 1/1995 Kawanaka et al. ..... 358/462
5,760,858 A * 6/1998 Hodson et al. ..... 349/61
5,778,104 A * 7/1998 Kowalski ..... 382/261
7,850,337 B2 * 12/2010 Kim ..... 362/234

FOREIGN PATENT DOCUMENTS

KR 1020060047260 5/2006
KR 1020060057183 5/2006
KR 1020070002880 1/2007
KR 1020070067521 6/2007

OTHER PUBLICATIONS

English Abstract for Publication No. 1020060047260, May 18, 2006.
English Abstract for Publication No. 1020060057183, May 26, 2006.
English Abstract for Publication No. 1020070002880, Jan. 5, 2007.
English Abstract for Publication No. 1020070067521, Jun. 28, 2007.

* cited by examiner

*Primary Examiner* — K. Wong
(74) *Attorney, Agent, or Firm* — F. Chau & Associates, LLC

(57) ABSTRACT

A display apparatus includes a backlight unit generating light, a display panel including a plurality of pixels controlling transmittance of the light based upon pixel data, a timing controller compensating the pixel data, and a data driver driving the display panel based upon the compensated pixel data. The display panel includes a first area to which the light having a first brightness is supplied and a second area to which the light having a second brightness lower than the first brightness is supplied. The timing controller compensates for the pixel data supplied to at least one area of the first and second areas using a predetermined compensation value to reduce a brightness difference between the first and second areas.

19 Claims, 9 Drawing Sheets

DISPLAY APPARATUS AND METHOD OF DRIVING THE SAME

CROSS-REFERENCE TO RELATED APPLICATION

This application claims priority to and the benefit of Korean Patent Application No. 2009-59244 filed on Jun. 30, 2009, the entire content of which is incorporated by reference herein.

BACKGROUND

1. Technical Field

The present disclosure relates to a display apparatus and, more particularly, to a display apparatus having improved image display quality and a method of driving the display apparatus.

2. Discussion of the Related Art

A liquid crystal display typically includes a liquid crystal panel having two substrates, a liquid crystal layer interposed therebetween and a backlight unit that supplies light to the liquid crystal panel. The liquid crystal display controls the transmittance of light passing through the liquid crystal layer, thereby displaying desired images.

The backlight unit typically includes a plurality of point light sources that emit light and a light guide plate that changes the paths of the light emitted from the point light sources. The light guide plate includes a light incident area to which the light is incident. However, the light incident area typically includes both a portion through which the light does not pass and a portion through which the light passes. As a result, a brightness difference can occur between the two portions.

SUMMARY

Exemplary embodiments of the present invention provide a display apparatus capable of compensating for the brightness difference of a backlight unit to improve image display quality.

Exemplary embodiments of the present invention also provide a method of driving the display apparatus.

According to an exemplary embodiment of the present invention, a display apparatus includes a backlight apparatus that generates light, a display panel that includes a plurality of pixels that control a transmittance of the light based upon pixel data and includes a first area to which light having a first brightness is supplied and a second area to which light having a second brightness lower than the first brightness is supplied, a data compensator that compensates for the pixel data supplied to the pixels arranged in at least one of the first area and the second area such that a brightness difference between the first area and the second area is compensated for, and a data driver that drives the display panel based upon the compensated pixel data.

The data compensator may compensate for the pixel data supplied to at least the second area based upon a predetermined compensation value.

The display apparatus may further include a memory in which the compensation value of the pixel data supplied to at least the second area is based upon a difference between the first brightness and the second brightness, and a detector that detects the pixel data corresponding to the second area among the pixel data.

The memory may include a look-up table indexed by the compensation value of the pixel data supplied to each of the pixels in the second area.

The display apparatus may further include a calculator that calculates an average brightness of red, green and blue data supplied to each of the pixels in the second area by using a tristimulus function.

The memory may include a look-up table indexed by the compensation value of the red, green and blue data supplied to each of the pixels in the second area based upon the average brightness.

The memory may be indexed by an algorithm to compensate for the pixel data supplied to the first area and the pixel data supplied to the second area by using a reference compensation value.

The reference compensation value may be set as an average value of the first brightness and the second brightness.

The backlight apparatus may include a backlight unit having at least one light source disposed adjacent to a side portion of the display panel.

The backlight apparatus may further include a backlight dimming controller that dims the brightness of the at least one light source of the backlight unit based upon the compensated pixel data.

According to an exemplary embodiment of the present invention a display apparatus includes a backlight unit having plurality of light sources that generate light, and a display panel that includes a plurality of pixels that control a transmittance of the light and includes a first area to which light having a first brightness is supplied and a second area to which light having a second brightness lower than the first brightness is supplied. Each of the pixels includes at least a white sub-pixel, a white sub-pixel of pixels being arranged in the second area having an area larger than an area of a white sub-pixel of the pixels arranged in the first area.

The display panel may include a third area in which no brightness difference is present and a fourth area in which the brightness difference is present in both of the first and second areas with reference to a reference imaginary line set at a predetermined position spaced apart from the light sources.

The white sub-pixel of each of the pixels arranged in the first area may have an area that decreases as an amount of light provided from the backlight unit increases, and the white sub-pixel of each of the pixels arranged in the second area may have an area that increases as the amount of light provided from the backlight unit decreases.

Each of the pixels may further include a red sub-pixel, a green sub-pixel, and a blue sub-pixel.

In accordance with an exemplary embodiment of the present invention, a method of driving a display apparatus includes preparing a display panel including a first area to which a light having a first brightness is supplied and a second area to which a light having a second brightness is supplied, setting a compensation value based upon a difference between the first brightness and the second brightness to compensate for a brightness difference between the first area and the second area, detecting, among pixel data supplied to pixels arranged in the first area and the second area, position information of the pixel data supplied to the pixels arranged in at least one of the first area and the second area, compensating for the pixel data supplied to the pixels arranged in the at least one area and providing the compensated pixel data to a data driver to drive the display panel.

The detecting of the position information of the pixel data and the compensating of the pixel data may be performed with respect to the pixel data supplied to the pixels arranged in the second area.

The method may further include calculating an average brightness of the pixel data using a tristimulus function after the setting of the compensation value, and the pixel data comprises may include red data, green data, and blue data.

The pixel data supplied to the pixels arranged in the second area may be compensated by the average brightness and the compensation value.

The pixel data supplied to the pixels in the first area and the second area may be compensated by an algorithm using a reference compensation value.

The reference compensation value may be set as an average value of the first brightness and the second brightness.

BRIEF DESCRIPTION OF THE DRAWINGS

The above and other advantages of the present invention will become readily apparent by reference to the following detailed description when considered in conjunction with the accompanying drawings wherein.

DESCRIPTION OF THE EXEMPLARY EMBODIMENTS

It will be understood that when an element or layer is referred to as being "on", "connected to" or "coupled to" another element or layer, it can be directly on, connected or coupled to the other element or layer or intervening elements or layers may be present.

Hereinafter, the exemplary embodiments of the present invention will be explained in detail with reference to the accompanying drawings.

Figure 1:
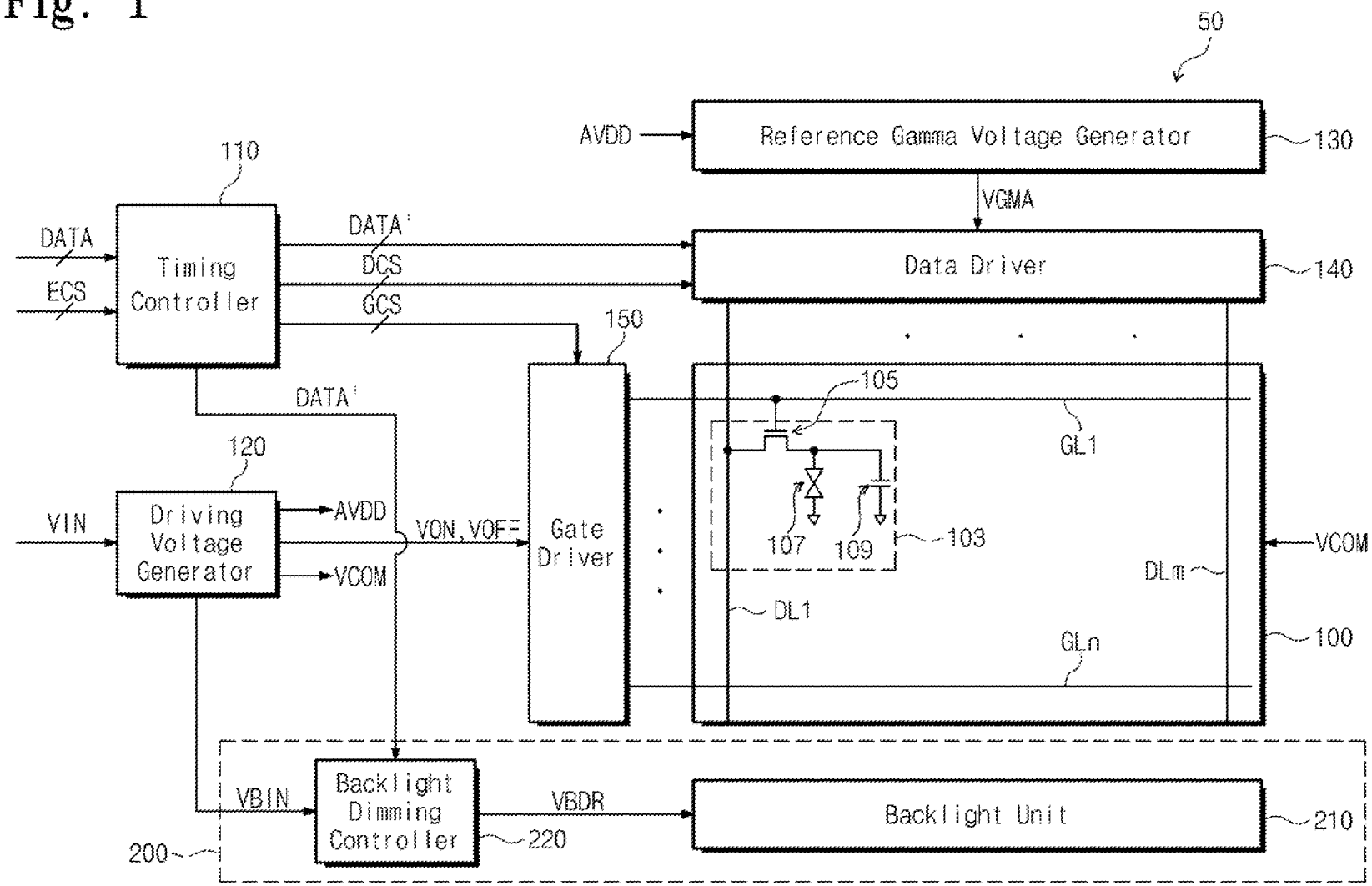
FIG. 1 is a block diagram showing a display apparatus according to an exemplary embodiment of the present invention.
Figure 2:
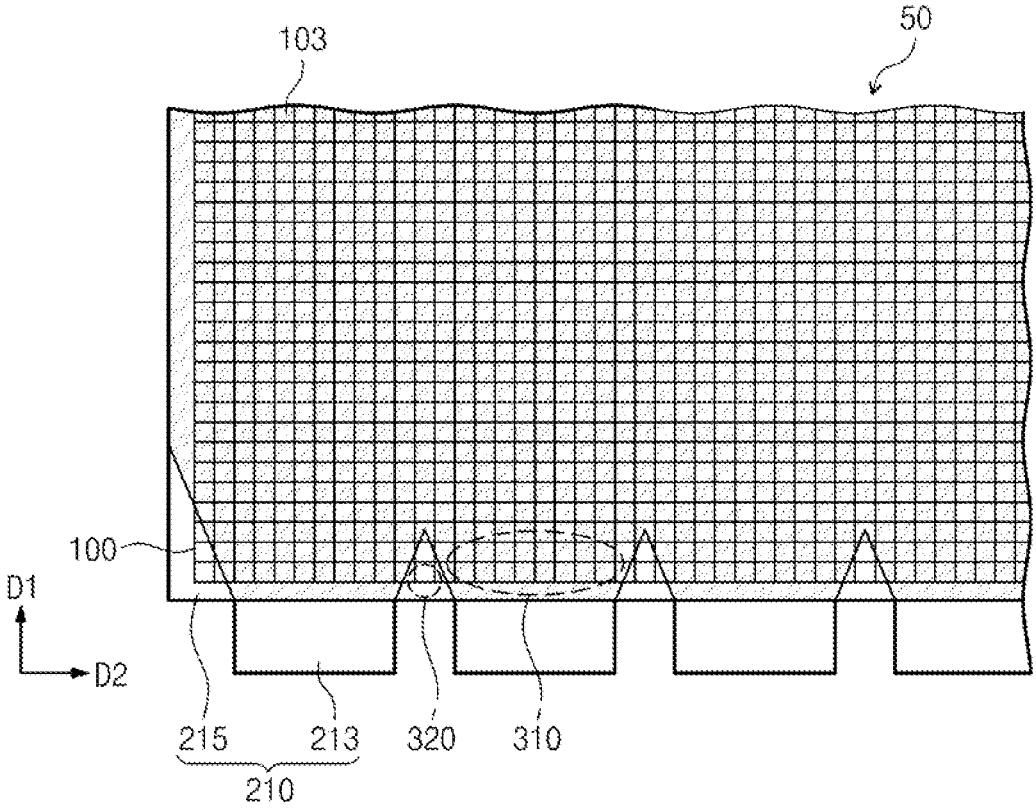
FIG. 2 is a plan view showing a display panel and a backlight unit of FIG. 1.

FIG. 1 is a block diagram showing a display apparatus according to an exemplary embodiment of the present invention, and FIG. 2 is a plan view showing a display panel and a backlight unit of FIG. 1.

Referring to FIG. 1 and FIG. 2, a display apparatus 50 includes a display panel 100, a timing controller 110, a driving voltage generator 120, a reference gamma voltage generator 130, a data driver 140, a gate driver 150, and a backlight apparatus 200. The backlight apparatus 200 includes a backlight unit 210 and a backlight dimming controller 220.

The display panel 100 includes an upper substrate, a lower substrate facing the upper substrate, and a liquid crystal layer disposed between the upper and lower substrates. In more detail, the display panel 100 includes a plurality of gate lines GL1, . . . GLn extending in a first direction and spaced apart from each other in a second direction substantially perpendicular to the first direction, a plurality of data lines DL1, . . . DLm extending in the second direction substantially perpendicular to the gate lines GL1, . . . GLn, a plurality of thin film transistors 105 each of which is connected to a corresponding gate line among the gate lines GL1, . . . GLn and a corresponding data line among the data lines DL1, . . . DLm, liquid crystal capacitors 107 respectively connected to the thin film transistors 105, and storage capacitors 109 respectively connected to the thin film transistors 105.

In addition, the display panel 100 includes a plurality of pixels 103 each having the thin film transistor 105, the liquid crystal capacitor 107, and the storage capacitor 109. In the exemplary embodiment the pixels 103 are arranged in a matrix form.

The timing controller 110 receives pixel data DATA and an external control signal ECS applied from an external device. The timing controller 110 generates a data control signal DCS and a gate control signal GCS based upon the external control signal ECS. The timing controller 110 applies the data control signal DCS and the gate control signal GCS to the data driver 140 and the gate driver 150, respectively. The timing controller 110 compensates for the pixel data DATA and supplies the pixel data DATA' to the data driver 140.

The driving voltage generator 120 receives an input voltage VIN from an external device to generate driving voltages, which are used to drive the display panel 100, the reference gamma voltage generator 130, the gate driver 150, and the backlight apparatus 200, and applies the driving voltages to the display panel 100, the reference gamma voltage generator 130, the gate driver 150, and the backlight apparatus 200. For example, the driving voltage generator 120 applies a common voltage VCOM to the display panel 100 and applies an analog driving voltage AVDD to the reference gamma voltage generator 130. The driving voltage generator 120 applies gate voltages VON and VOFF to the gate driver 150, and applies a backlight input voltage VBIN to the backlight apparatus 200.

The reference gamma voltage generator 130 generates a plurality of reference gamma voltages VGMA by using the analog driving voltage AVDD, and applies the reference gamma voltages VGMA to the data driver 140.

The data driver 140 converts the pixel data DATA' received from the timing controller 110 into an analog data voltage using the data control signal DCS and the reference gamma voltages VGMA, and applies the analog data voltage to the display panel 100.

The gate driver 150 generates gate signals by using the gate control signal GCS and the gate voltages VON and VOFF and applies the gate signals to the gate lines GL1, . . . GLn.

The backlight unit 210 is an edge illumination type to supply light to the display panel 100. Particularly, the backlight unit 210 of the backlight apparatus 200 includes a plurality of light emitting diodes 213 disposed adjacent to a side portion of the display panel 100 and a light guide plate 215 that change the path of the light emitted from the light emitting diodes 213 while guiding the light therethrough. The light emitting diodes 213 are arranged in a second direction D2 substantially perpendicular to a first direction D1 toward which the light emitted from the light emitting diodes 213 travels. The light emitting diodes 213 are spaced from each other with a predetermined interval to emit the light, and the light guide plate 215 changes the path of the light emitted from the light emitting diodes 213 to travel toward the display panel 100.

The light guide plate 215 includes a bright area toward which the light emitted from the light emitting diodes 213 travels and a dark area toward which the light emitted from the light emitting diodes 213 does not travel. In this case, a portion of the light may exit from the dark area toward the display panel 100. However, light exiting from the dark area has an extremely low brightness as compared to light exiting from the bright area.

A brightness difference occurs in a light incident area of the light guide plate 215, to which the light emitted from the light emitting diodes 213 is supplied, according to a light incident position within the light incident area. For instance, according to the light emitting angle of the light emitting diodes 213, light having a first brightness exits from the bright area toward the display panel 100 and light having a second brightness lower than the first brightness exits from the dark area toward the display panel 100.

For dimming the backlight unit 210, the backlight dimming controller 220 compensates for the backlight input voltage VBIN from the driving voltage generator 120 based upon the pixel data DATA' applied from the timing controller 110 and controls the compensated backlight input voltage VBIN to apply the backlight input voltage VBIN to the backlight unit 210 as a backlight driving voltage VBDR. The backlight dimming controller 220 may dim the backlight unit 210 corresponding to the image displayed on a whole area of the display panel 100, or may dim the backlight unit 210 corresponding to plural areas of the image displayed on the display panel 100. For example, if the light guide plate 215 is divided into multiple rows or columns, the backlight dimming controller 220 may independently control the brightness in each row or column corresponding to multiple areas of the image displayed on the display panel 100.

As shown in FIG. 2, the display panel 100 includes a first area 310 that receives the light having the first brightness from the backlight unit 210 and a second area 320 that receives the light having the second brightness from the backlight unit 210. Accordingly, the display panel 100 displays the image in the first brightness through the first area 310 and displays the image in the second brightness through the second area 320 since the display panel 100 receives the light having the first brightness through the first area 310 and the light having the second brightness through the second area 320. Therefore, the brightness in the second area 320 must be compensated for to reduce the brightness difference between the first and second areas 310, 320, thereby preventing the occurrence of a perceived display defect of the display penal 100, caused by the brightness difference.

Hereinafter, a method of reducing the brightness difference of the backlight unit 210 will be described in more detail.

Figure 3:
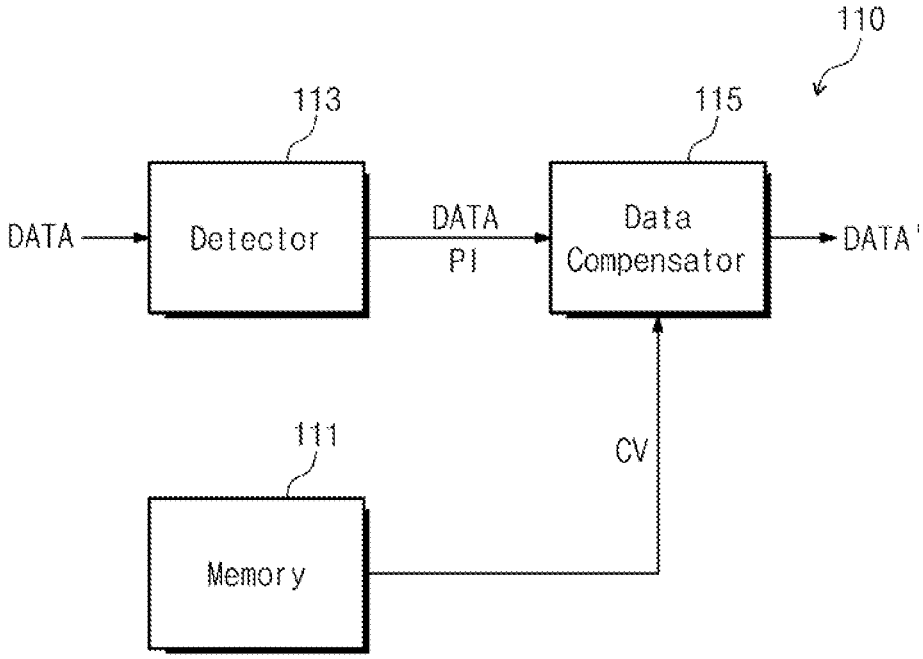
FIG. 3 is a block diagram showing a timing controller according to an exemplary embodiment of the present invention.

FIG. 3 is a block diagram showing a timing controller according to an exemplary embodiment of the present invention.

Referring to FIG. 3, the timing controller 110 includes a memory 111, a detector 113, and a data compensator 115. The timing controller 110 receives the pixel data DATA from the external device, compensates for the pixel data DATA, and supplies the compensated pixel data DATA' to the data driver (not shown in FIG. 3).

The memory 111 stores compensation values CV that are set to compensate for the brightness difference between the areas of the display panel 100. In more detail, the memory 111 includes a look-up table indexed by the compensation values CV. The compensation values CV are used to compensate for the brightness difference of the image displayed on the display panel 100, which is caused by the brightness difference of the light from the backlight unit 210. The compensation values CV are set to compensate for the brightness difference between the areas of the display panel 100 based upon a result obtained by measuring the brightness of the light from the backlight unit 210. In addition, the compensation values CV are set to correspond to the difference between the first brightness and the second brightness to compensate for the brightness difference between the image displayed in the first area 310 of the display panel 100 to which the light having the first brightness is supplied and the image displayed in the second area 320 of the display panel 100 to which the light having the second brightness is supplied. That is, the compensation values CV are used to compensate for the pixels 103 arranged corresponding to the second area 320.

For example, if the light generated by the backlight unit 210 has a brightness corresponding to gray scales of 0 to 255, the compensation values CV are set based upon the brightness difference between the first and second areas 310, 320. In the case where the brightness difference between the first and second areas 310, 320 corresponds to 1 to 15 gray scales, the compensation values CV are set to compensate for the pixel data DATA provided to each pixel 103 in the second area 320 by the gray scales of 1 to 15. In this case, the compensation values CV of the memory 111 may be set with reference to the gray scales that may be displayed by the pixels 103.

The detector 113 receives the pixel data DATA from the external device to detect position information PI of the pixel data DATA. Particularly, the detector 113 detects the position information PI included in the pixel data DATA to check whether the pixel data DATA is supplied to the pixels 103 in the second area 320 or not. The detector 113 provides the data compensator 115 with the pixel data DATA and the position information PI of the pixel data DATA.

The data compensator 115 receives the pixel data DATA and the position information PI of the pixel data DATA supplied to the second area 320 from the detector 113, and receives the compensation values CV, which are set in the look-up table, from the memory 111. The data compensator 115 compensates the pixel data DATA supplied to the second area 320 based upon the compensation values CV and provides the compensated pixel data DATA' to the data driver 140 (shown in FIG. 1). For instance, when the data compensator 115 receives the pixel data DATA corresponding to 240-value gray scale, the data compensator 115 receives the compensation values CV corresponding to 15-value gray scale set in the look-up table to compensate for the pixel data DATA to have 255-value gray scale.

If the pixel data DATA having the highest gray scale level that may be displayed by the pixels 103 is supplied to the data compensator 115, the data compensator 115 may provide the pixel data DATA to the data driver 140 without compensating the pixel data DATA from the detector 113. For example, when assuming that the gray scale range that may be displayed by the pixels 103 is 0 to 255 and the pixel data DATA having the 255-value gray scale is supplied to the data compensator 115, the data compensator 115 provides the pixel data DATA' to the data driver without compensating the pixel DATA from the detector 113 since the pixel data DATA does not need to be compensated by using the compensation values CV.

The memory 111 may be located outside the timing controller 110. The memory 111 provides the data compensator 115 with the compensation values CV in response to a request from the timing controller 110.

As described above, the timing controller 110 can compensate for the pixel data DATA in correspondence with the brightness difference of the light generated by the backlight unit 210, thereby preventing deterioration of the display quality of the display panel 100 caused by the brightness difference of the light generated by the backlight unit 210.

Figure 4:
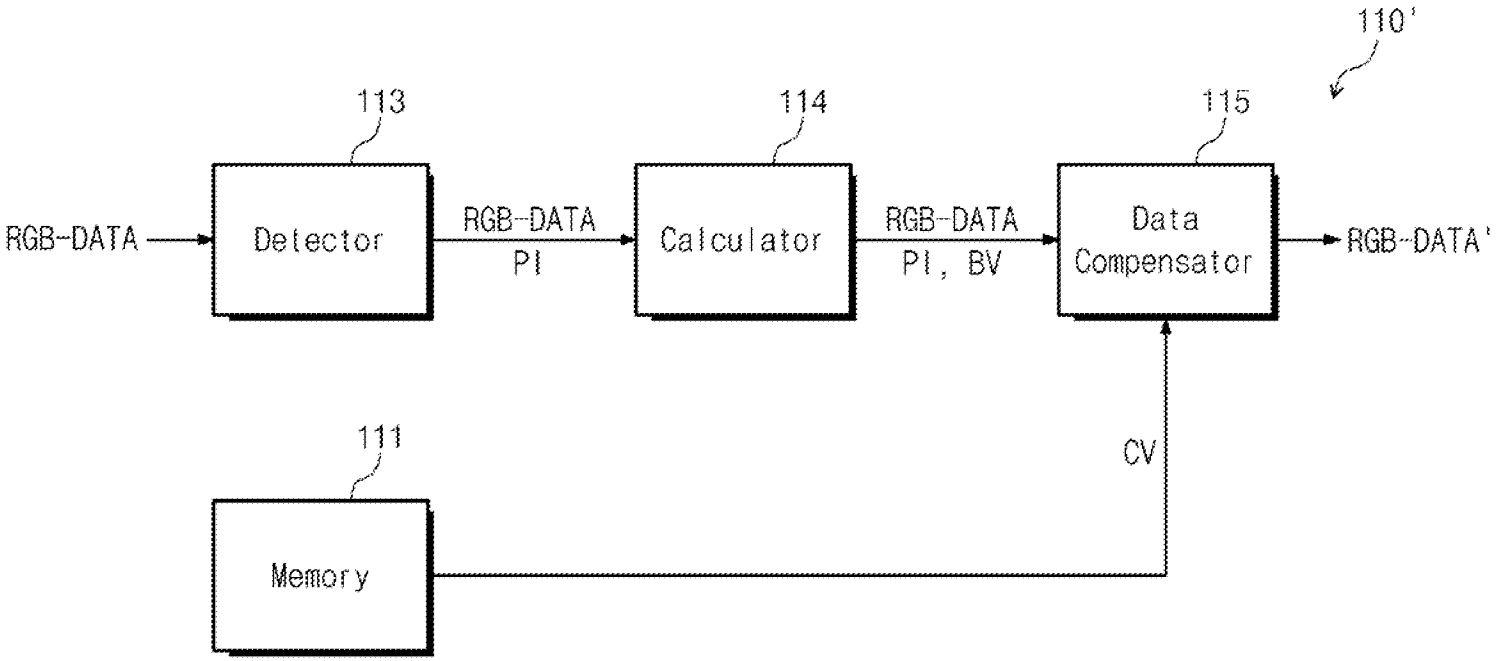
FIG. 4 is a block diagram showing a timing controller according to an exemplary embodiment of the present invention.

FIG. 4 is a block diagram showing a timing controller 110' according to an exemplary embodiment of the present invention. In FIG. 4, the same reference numerals denote the same elements in FIG. 3, and thus, detailed descriptions of the same elements will be omitted.

Referring to FIG. 4, a timing controller 110' includes a memory 111, a detector 113, a calculator 114, and a data compensator 115. The timing controller 110' receives red, green and blue data RGB-DATA, compensates for the red, green and blue data RGB-DATA, and provides the compensated red, green and blue data RGB-DATA' to the data driver 140 (shown in FIG. 1).

The memory 111 includes a look-up table in which compensation values CV set to compensate for the brightness difference between the areas of the display panel 100 are stored. In this case, the look-up table is indexed by the compensation values CV corresponding to the red, green and blue data RGB supplied to the pixels 103 in the second area 320.

The detector 113 receives the red, green and blue data RGB-DATA from the external device and detects position information PI included in the red, green and blue data RGB-DATA to check whether the red, green and blue data RGB-DATA is supplied to the pixels 103 in the second area 320 or not. The detector 113 provides the calculator 114 with the red, green and blue data RGB-DATA and the position information PI of the red, green and blue data RGB-DATA.

The calculator 114 calculates an average brightness BV of the red, green and blue data RGB-DATA supplied to the pixels 103 in the second area 320 by using the tristimulus function, and provides the data compensator 115 with the average brightness BV, the red, green and blue data RGB-DATA, and the position information PI. For instance, the calculator 114 receives the red data R of 240-value gray-scale, the green data of 100-value gray-scale, and the blue data of 210-value gray-scale and calculates the average brightness BV. In this case, the calculator 114 outputs the average brightness of 200-value gray-scale.

The data compensator 115 receives the average brightness BV, the red, green and blue data RGB-DATA, and the position information PI of the red, green and blue data RGB-DATA from the calculator 114 and receives the compensation values CV set in the look-up table from the memory 111. The data compensator 115 compensates for the red, green and blue data RGB-DATA based upon the average brightness BV and the compensation values CV. For example, the data compensator 115 compensates the red data R of 240-value gray-scale, the green data of 100-value gray-scale, and the blue data of 210-value gray-scale by using the average brightness of 200-value gray-scale and the compensation values CV of 15-value gray-scale.

As described above, the timing controller 110' can compensate for the red, green and blue data RGB-DATA in correspondence with the brightness difference of the light generated by the backlight unit 210, thereby preventing deterioration of the display quality of the display panel 100 caused by the brightness difference of the light generated by the backlight unit 210.

Figure 5:
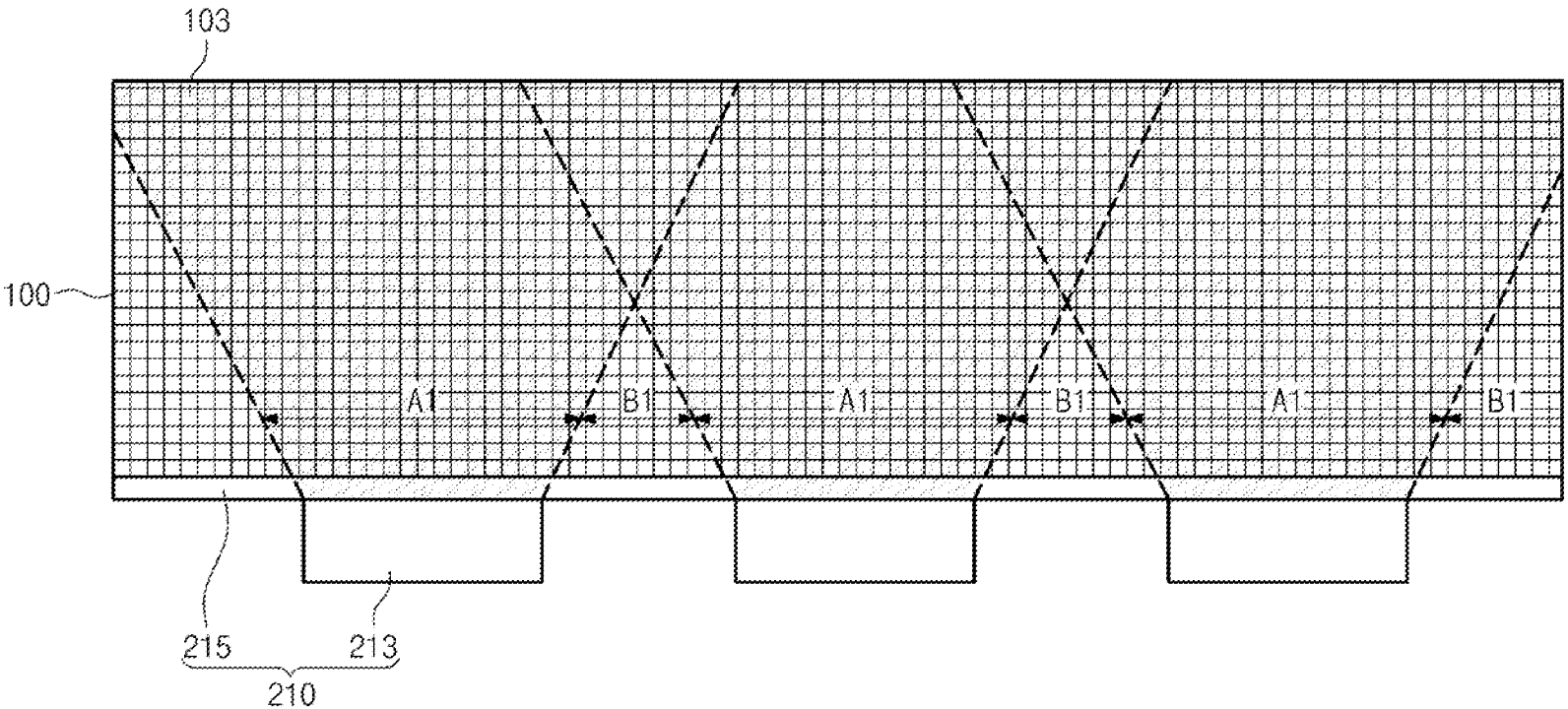
FIG. 5 is a plan view showing a display apparatus to explain a timing controller according to an exemplary embodiment of the present invention.
Figure 6:
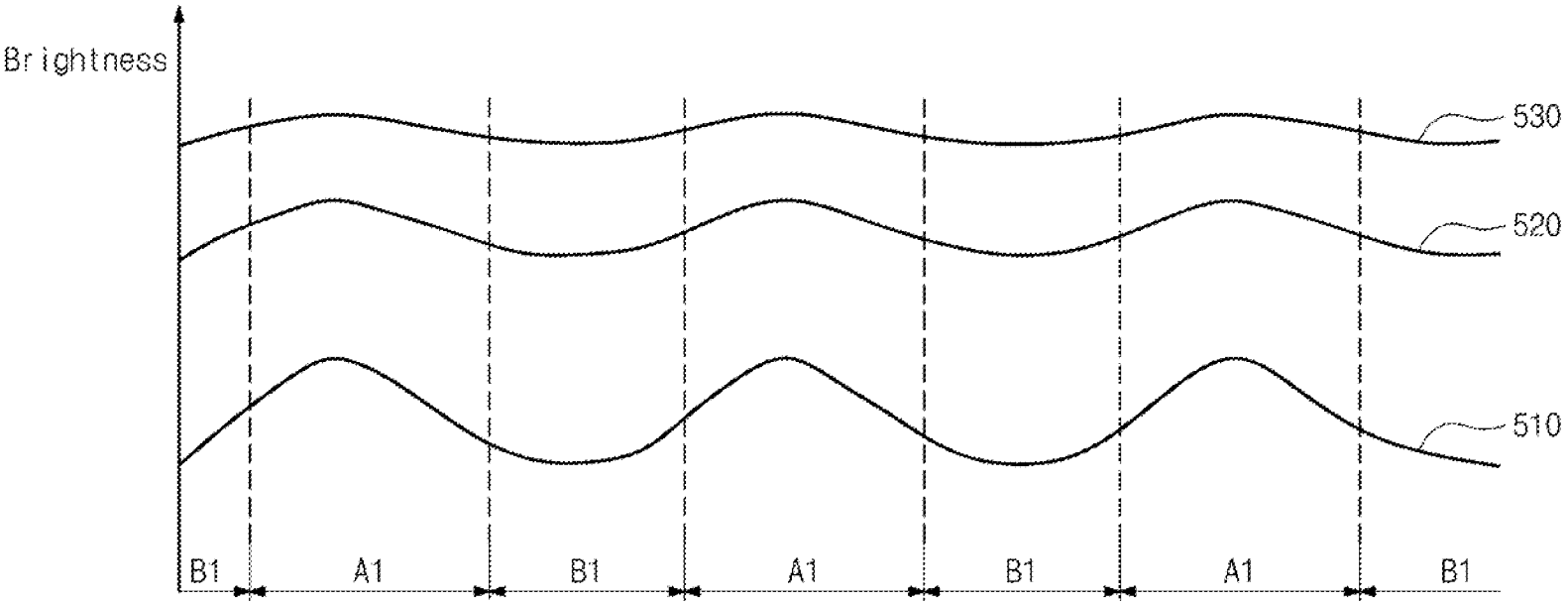
FIG. 6 is a graph showing brightness in each area of FIG. 5.

FIG. 5 is a plan view showing a display apparatus to explain a timing controller according to an exemplary embodiment of the present invention. FIG. 6 is a graph showing brightness in each area of FIG. 5. In the present exemplary embodiment, the timing controller will be described with reference to FIG. 3, FIG. 5 and FIG. 6.

Referring to FIG. 3, FIG. 5, and FIG. 6, the display panel 100 receives the light from the backlight unit 210 that includes the light emitting diodes 213 emitting the light and the light guide plate 215 that changes the path of the light from the light emitting diodes 213. The display panel 100 includes first areas A1 that are within a light emitting angle of the light emitting diodes 213 to receive the light having a first brightness and second areas B1 that are outside the light emitting angle of the light emitting diodes 213 to receive the light having a second brightness different from the first brightness. The display panel 100 has a brightness distribution in the first areas A1 different from a brightness distribution in the second areas B1. In addition, the display panel 100 may have various brightness distributions according to the distance between the display panel 100 and the light emitting diodes 213. That is, when assuming that a (n+2)th pixel row, a (n+1)th pixel row, and a n-th pixel row are sequentially arranged from an end portion of the display panel 100 to which the light emitting diodes 213 are adjacent, as shown in FIG. 6, the display panel 100 has brightness distributions in areas of the n-th pixel row, the (n+1)th pixel row, and the (n+2)th pixel row, respectively corresponding to a first curve 510, a second curve 520, and a third curve 530.

The timing controller 111 includes the memory 111, the detector 113, and the data compensator 115. The timing controller 111 receives the pixel data DATA from the external device, compensates for the pixel data DATA, and provides the data driver 140 (shown in FIG. 1) with the compensated pixel data DATA'.

The memory 111 includes an algorithm stored therein to compensate for the brightness in each area of the displays panel 100 using a reference compensation value based upon the graphs representing the brightness distribution of each area of the display panel 100. In more detail, the algorithm stored in the memory 111 compensates for the brightness in the first and second areas A1, B1 using the reference compensation value based upon the first, second and third curves 510, 520, 530. The reference compensation value is set to an average brightness of the first brightness and the second brightness. In the present exemplary embodiment, the algorithm may be represented as a graph or derived from a function, which reversely compensates for the first, second, and third curves 510, 520, 530.

The detector 113 receives the pixel data DATA from the external device and detects position information PI of the pixel data DATA to check where the pixel data DATA is supplied to the pixels 103 in the first areas A1 or the second areas B1. The detector 113 provides the data compensator 115 with the pixel data DATA and the position information PI of the pixel data DATA.

The data compensator 115 receives the pixel data DATA and the position information PI of the pixel data DATA supplied to the pixels 103 in the second areas B1 from the detector 113, and receives the reference compensation value from the memory 111. The data compensator 115 compensates for the pixel data DATA supplied to the pixels 103 in the first areas A1 and the second areas B1 using the reference compensation value and provides the data driver 140 (shown in FIG. 1) with the compensated pixel data DATA'. For example, the data compensator 115 decreases the gray scale of the pixel data DATA supplied to the pixels 103 in the first areas A1 using the algorithm before the pixel data DATA is supplied to the pixels 103 in the first areas A1, and the data compensator 115 increases the gray scale of the pixel data DATA supplied to the pixels 103 in the second areas B1 using the algorithm before the pixel data DATA is supplied to the pixels 103 in the second areas B1.

The timing controller 110 may drive the display panel 100 such that the brightness distribution of the light provided to the display panel 100 from the backlight unit 210 is compensated to be the average brightness using the algorithm that reversely compensates for the brightness distribution.

Figure 7:
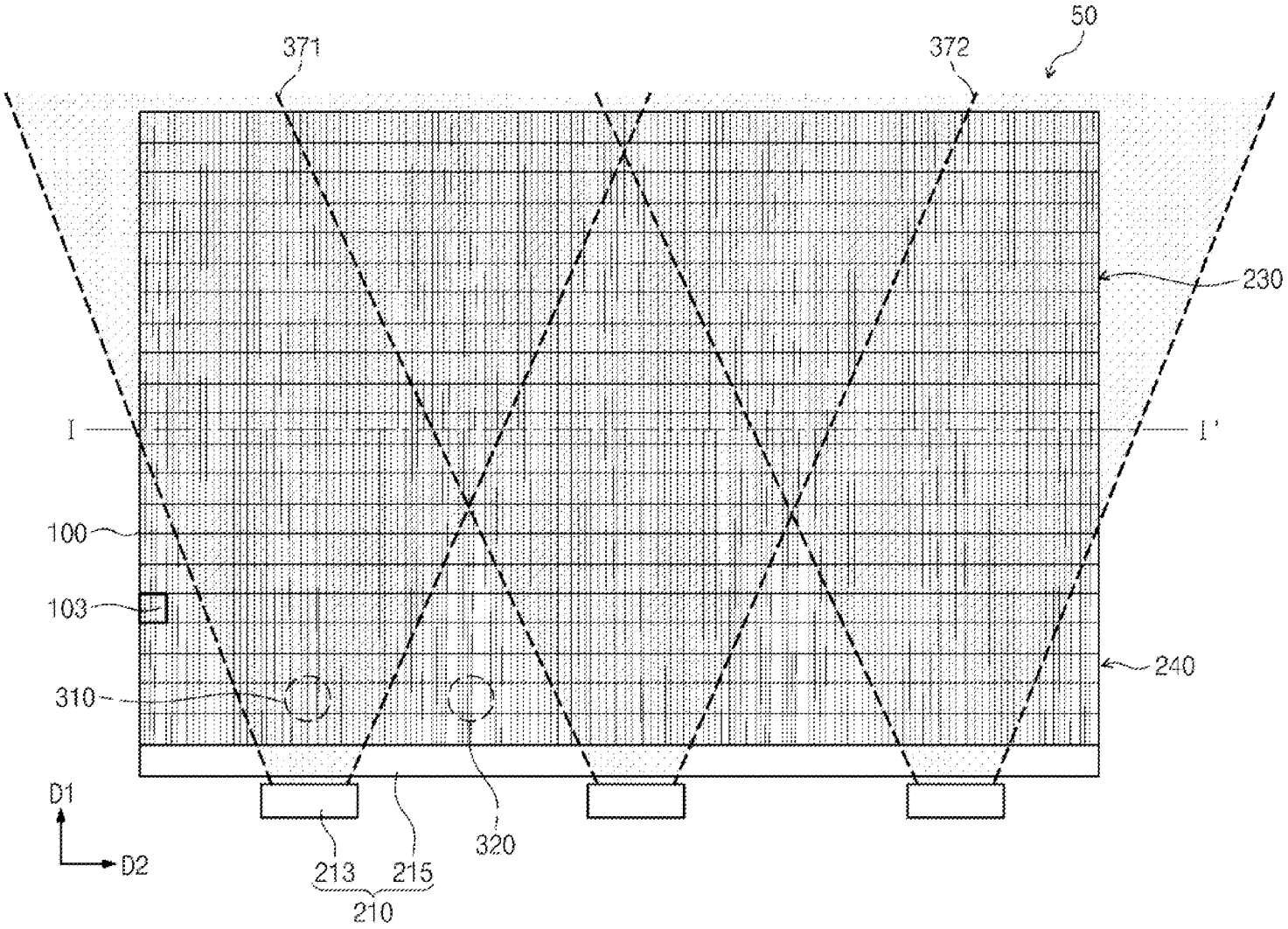
FIG. 7 is a plan view showing a display apparatus according to an exemplary embodiment of the present invention.
Figure 8:
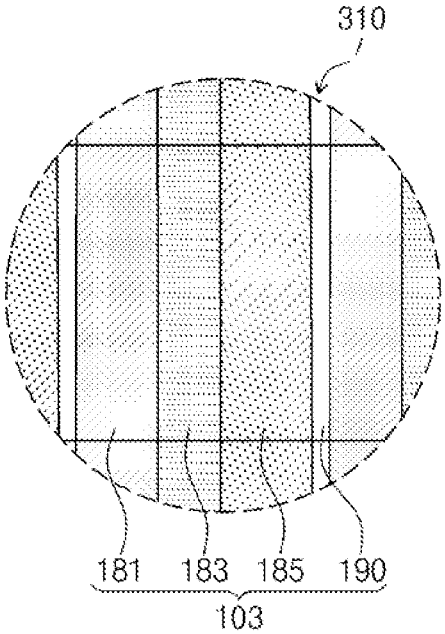
FIG. 8 is a partially enlarged view showing a first area of a display panel of FIG. 7.
Figure 9:
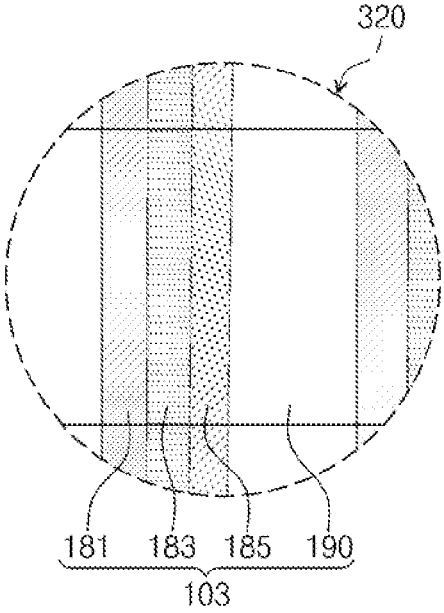
FIG. 9 is a partially enlarged view showing a second area of a display panel of FIG. 7.

FIG. 7 is a plan view showing a display apparatus according to an exemplary embodiment of the present invention. FIG. 8 is a partially enlarged view showing a first area 310 of a display panel of FIG. 7. FIG. 9 is a partially enlarged view showing a second area 320 of a display panel of FIG. 7. In FIG. 7, for the convenience of explanation, only the display panel and the backlight unit have been shown.

Referring to FIG. 7, FIG. 8 and FIG. 9, a display apparatus includes a display panel 100 and a backlight unit 210.

The display panel 100 includes a plurality of pixels 103 that controls the transmittance of light. The display panel 100 includes a first area 310 receiving the light having a first brightness from the backlight unit 210 and a second area 320 having a second brightness lower than the first brightness from the backlight unit 210.

The backlight unit 210 includes a plurality of light emitting diodes 213 that emit the light and a light guide plate 215 that receives the light emitted from the light emitting diodes 213 and changes the paths of the light from the light emitting diodes 213.

The light emitting diodes 213 emit the light to travel in a first direction D1 and are arranged in a second direction D2 substantially perpendicular to the first direction D1 to be spaced apart from each other. Each of the light emitting diodes 213 emits the light in a predetermined angle defined by a first imaginary line 371 and a second imaginary line 372.

The light guide plate 215 includes a side portion to which the light emitting diodes 213 are adjacent and is disposed under the display panel 100. The light guide plate 215 includes a bright area toward which the light emitted from the light emitting diodes 213 travels and a dark area toward which the light emitted from the light emitting diodes 213 does not travel. Thus, the light guide plate 215 may supply the light to the display panel 100 to have different brightness in the bright and dark areas. For example, the light supplied to the first area 310 through the bright area of the light guide plate 215 has the first brightness, and the light supplied to the second area 320 through the dark area of the light guide plate 215 has the second brightness. In addition, the light guide plate 215 includes a third area 230 in which no brightness difference of the light supplied to the display panel 100 is present and a fourth area 240, in which the brightness difference of the light supplied to the display panel 100 is present, corresponding to the first and second areas 310, 320 of the display panel 100.

To compensate for the brightness difference of the light from the backlight unit 210, the display panel 100 includes the pixels 103 having different transmittance according to the brightness difference. In more detail, the display panel 100 includes the pixels 103 having a first transmittance corresponding to the first area 310 to which the light having the first brightness is supplied, and includes the pixels 103 having a second transmittance, which is higher than the first transmittance, corresponding to the second area 320 to which the light having the second brightness is supplied.

In the present exemplary embodiment, each of the pixels 103 of the display panel 100 includes a first sub-pixel 181 displaying a red color R, a second sub-pixel 183 displaying a green color G, a third sub-pixel 185 displaying a blue color B, and a fourth sub-pixel 190 displaying a white color W.

The light transmittance of each pixel 103 increases depending on increasing the area of the fourth sub-pixel 190. The fourth sub-pixel 190 of each of the pixels 103 arranged in the second area 320 has an area larger than an area of the fourth sub-pixel 190 of each of the pixels 103 arranged in the first area 310. In addition, since the pixels 103 arranged in the second area 320 are positioned corresponding to between two adjacent light emitting diodes 213, the area of the fourth sub-pixel 190 of each of the pixels 103 arranged in the second area 320 increases as the amount of the light provided from the backlight unit 210 decreases, and the area of the fourth sub-pixel 190 of each of the pixels 103 arranged in the second area 320 decreases as the amount of the light provided from the backlight unit 210 increases. In other words, the fourth sub-pixel 190 of the pixels 103 arranged in the second area 320 has the area increasing as it is spaced apart from the two adjacent light emitting diodes 213 and as it is closer to a center portion of the two adjacent light emitting diodes 213.

The area of the fourth sub-pixel 190 of the pixels 103 arranged in the first area 310 is varied depending on the third and fourth areas 230, 240 of the light guide plate 215. Particularly, the fourth sub-pixel 190 of the pixels 103 arranged in the first area 310 corresponding to the third area 230 has the same area. In addition, the fourth sub-pixel 190 of the pixels 103 arranged in the first area 310 corresponding to the fourth area 240 has an area gradually decreasing as it becomes close to the light emitting diodes 213.

Figure 10:
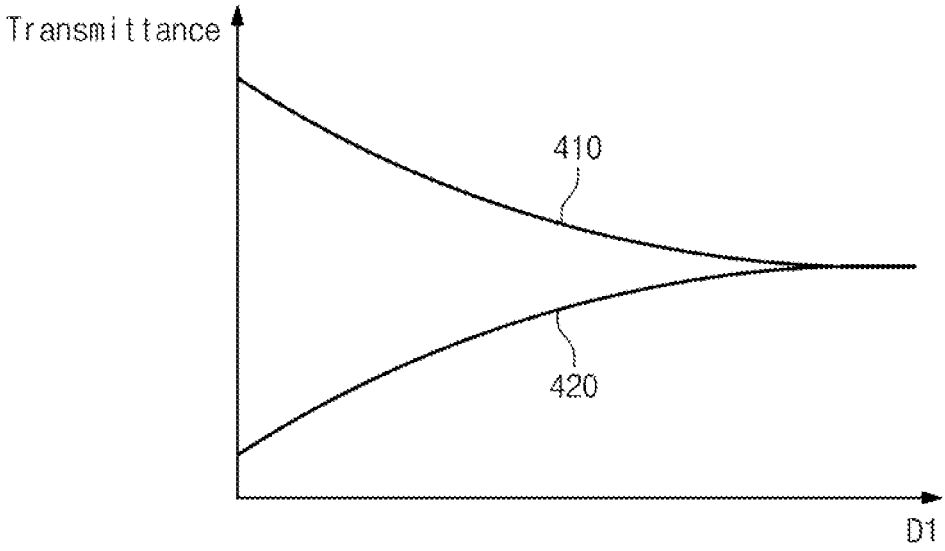
FIG. 10 and FIG. 11 are graphs showing transmittance of a display panel of FIG. 7.
Figure 11:
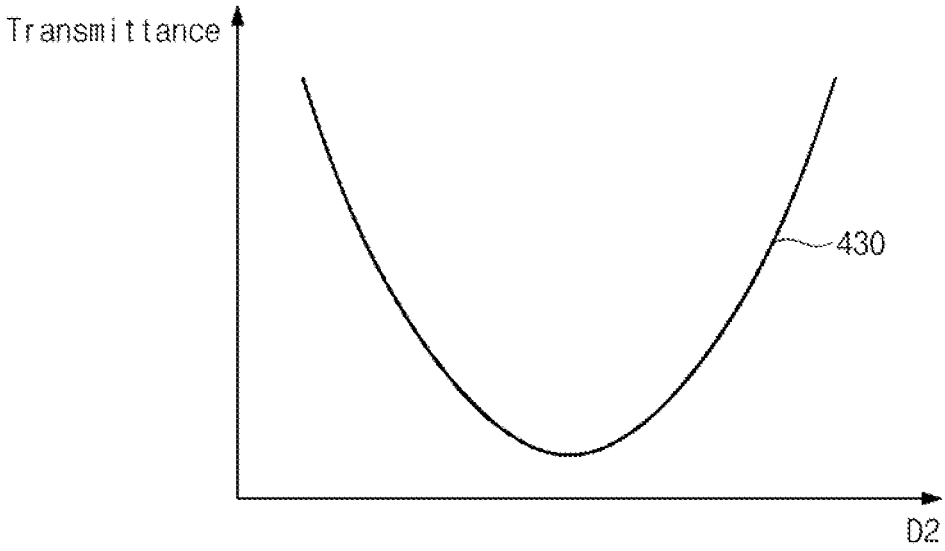

Hereinafter, the brightness distribution of the pixels 103 will be further described with reference to FIG. 10 and FIG. 11. FIG. 10 and FIG. 11 are graphs showing transmittance of a display panel of FIG. 7.

The pixels 103 arranged in the first area 310 have the transmittance corresponding to a fourth curve 420 as they are spaced apart from the light emitting diodes 213 in the first direction D1, and the pixels 103 arranged in the second area 320 have the transmittance corresponding to the fifth curve 410 as they are spaced apart from the light emitting diodes 213 in the first direction D1. As shown in FIG. 10, the transmittance of the pixels 103 arranged in the first area 310 becomes the same as the transmittance of the pixels 103 arranged in the second area 320 as they become further from the light emitting diodes 213 in the first direction D1.

In addition, the pixels 103 arranged in the first area 310 and the pixels 103 arranged in the second area 320 have the transmittance corresponding to a sixth curve 430 in the second direction D2. As shown in FIG. 11, the pixels 103 of the display panel 100 have the transmittance in the first and second areas 310, 320, which is inversely proportional to the first brightness and the second brightness.

As described above, the display panel 100 includes the fourth sub-pixel 190 having the area inversely proportional to the amount of the light provided from the backlight unit 210, to thereby compensate for the brightness difference of the light provided from the backlight unit 210.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus comprising:

a backlight apparatus that generates light;

a timing controller that generates a control signal and pixel data;

a display panel that includes a plurality of pixels that controls a transmittance of the light based upon the pixel data and includes a first area to which light having a first brightness is supplied and a second area to which light having a second brightness lower than the first brightness is supplied; and a data driver that drives the display panel based upon a compensated pixel data, wherein each of the pixels comprises at least a white sub-pixel, a white sub-pixel of pixels being arranged in the second area having an area larger than an area of a white sub-pixel of the pixels arranged in the first area, and wherein the timing controller comprises:

a memory that stores compensation value of the pixel data supplied to at least one of the first area and the second area is based upon a difference between the first brightness and the second brightness;

a detector that detects the pixel data corresponding to at least one of the first area and the second area among the pixel data; and a data compensator that generates the compensated pixel data for the pixel data supplied to the pixels arranged in at least one of the first area and the second area such that a brightness difference between the first area and the second are is compensated for.

2. The display apparatus of claim 1, wherein the data compensator compensates for the pixel data supplied to at least the second area based upon a predetermined compensation value.

3. The display apparatus of claim 1, wherein the memory comprises a look-up table indexed by the compensation value of the pixel data supplied to each of the pixels in the second area.

4. The display apparatus of claim 1, further comprising a calculator that calculates an average brightness of red, green and blue data supplied to each of the pixels in the second area by using a tristimulus function.

5. The display apparatus of claim 4, wherein the memory comprises a look-up table indexed by the compensation value of the red, green and blue data supplied to each of the pixels in the second area based upon the average brightness.

6. The display apparatus of claim 2, wherein the memory is indexed by an algorithm to compensate for the pixel data supplied to the first area and the pixel data supplied to the second area by using a reference compensation value.

7. The display apparatus of claim 6, wherein the reference compensation value is set as an average value of the first brightness and the second brightness.

8. The display apparatus of claim 1, wherein the backlight apparatus comprises a backlight unit having at least one light source disposed adjacent to a side portion of the display panel.

9. The display apparatus of claim 8, wherein the backlight apparatus further comprises a backlight dimming controller that dims the brightness of the at least one light source of the backlight unit based upon the compensated pixel data.

10. A display apparatus comprising:

a backlight unit having a plurality of light sources that generates light; and a display panel that includes a plurality of pixels that controls a transmittance of the light and includes a first area to which light having a first brightness is supplied and a second area to which light having a second brightness lower than the first brightness is supplied, wherein each of the pixels comprises at least a white sub-pixel, a white sub-pixel of pixels being arranged in the second area having an area larger than an area of a white sub-pixel of the pixels arranged in the first area.

11. The display apparatus of claim 10, wherein the display panel comprises a third area in which no brightness difference is present and a fourth area in which the brightness difference is present in both of the first and second areas with reference to a reference imaginary line set at a predetermined position spaced apart from the light sources.

12. The display apparatus of claim 11, wherein the white sub-pixel of each of the pixels arranged in the first area has an area that decreases as an amount of light provided from the backlight unit increases, and the white sub-pixel of each of the pixels arranged in the second area has an area that increases as the amount of light provided from the backlight unit decreases.

13. The display apparatus of claim 10, wherein each of the pixels further comprises a red sub-pixel, a green sub-pixel, and a blue sub-pixel.

14. A method of driving a display apparatus, comprising:

preparing a display panel including a first area to which a light having a first brightness is supplied and a second area to which a light having a second brightness is supplied;

setting a compensation value based upon a difference between the first brightness and the second brightness to compensate for a brightness difference between the first area and the second area;

detecting, among pixel data supplied to pixels arranged in the first area and the second area, position information of the pixel data supplied to the pixels arranged in at least one of the first area and the second area;

compensating for the pixel data supplied to the pixels arranged in the at least one area; and providing the compensated pixel data to a data driver to drive the display panel, wherein each of the pixels comprises at least a white sub-pixel, a white sub-pixel of pixels being arranged in the second area having an area larger than an area of a white sub-pixel of the pixels arranged in the first area.

15. The method of claim 14, wherein the detecting of the position information of the pixel data and the compensating of the pixel data are performed with respect to the pixel data supplied to the pixels arranged in the second area.

16. The method of claim 14, further comprising calculating an average brightness of the pixel data using a tristimulus function after the setting of the compensation value, and wherein the pixel data comprises red data, green data, and blue data.

17. The method of claim 16, wherein the pixel data supplied to the pixels arranged in the second area is compensated by the average brightness and the compensation value.

18. The method of claim 14, wherein the pixel data supplied to the pixels in the first area and the second area is compensated by an algorithm using a reference compensation value.

19. The method of claim 18, wherein the reference compensation value is set as an average value of the first brightness and the second brightness.

* * * * *